United States Patent [19]

Giessler et al.

[11] 4,037,541

[45] July 26, 1977

[54] TRACK FOR A COMBINED MONORAIL AND OVERHEAD MONORAIL

[76] Inventors: Horst Giessler, Salzboden Strasse 22, CH-4310 Rheinfelden, Switzerland; Klaus Lückerath, 2 Prattelnerstr. 8, D-7889 Grenzach-Wyhlen 2, Germany

[21] Appl. No.: 623,202

[22] Filed: Oct. 16, 1975

[30] Foreign Application Priority Data

Oct. 17, 1974 Germany ..... 7434754[U]

[51] Int. Cl.[2] ..... E01B 25/08; E01B 25/22

[52] U.S. Cl. ..... 104/109; 16/95 R; 16/96 R; 104/118; 104/124

[58] Field of Search ..... 104/89, 106, 107, 108, 104/109, 118, 124, 94, 95, 111, 126; 105/141, 148, 154, 155; 16/87.4 R, 94 R, 95 R, 96 R; 238/152

[56] References Cited

U.S. PATENT DOCUMENTS

| | | | |
|---|---|---|---|
| 509,650 | 11/1893 | Brodie | 104/108 |
| 753,481 | 3/1904 | Ferris | 104/107 |
| 1,722,291 | 7/1929 | Hanak | 104/107 |
| 3,043,408 | 7/1962 | Attwood | 189/34 G |
| 3,327,644 | 6/1967 | Black | 104/106 |
| 3,345,954 | 10/1967 | Valentin-Hjorta | 104/108 X |

*Primary Examiner*—Robert J. Spar
*Assistant Examiner*—Randolph A. Reese
*Attorney, Agent, or Firm*—Allison C. Collard

[57] ABSTRACT

A track for combined monorail and overhead monorail having a power supply and control tracks consisting of a U-shaped rail section having inwardly extending flanges at its upper sides for receiving the rollers or wheels of the accessory device. At least one shoulder section is formed on the lower surface of the bottom portion of the U-shaped rail section as well as on the upper surface of the upper inwardly extending flange so that the track can be mounted on a suitable support or suspension structure.

6 Claims, 3 Drawing Figures

TRACK FOR A COMBINED MONORAIL AND OVERHEAD MONORAIL

This invention relates to a track for a combined monorail and overhead monorails essentially consisting of a U-shaped section having inwardly extended flanges at its upper side for receiving rollers or wheels of a moving gear. Also included is a power supply and control tracks as well as a gear rack in the lower area of the section.

Tracks for monorails and overhead monorails are already known. These known tracks essentially consist of plastic, whereby the power supply and control tracks are mounted in special sections in the lower portion of the track. The moving gear of such tracks are provided with outwardly directed wheels or rollers which are driven and which engage the inwardly extended flanges of the track when the combined monorailway is in operation. When the track is mounted on the ground, the moving gear engages the lower surface of the U-shaped section of the track.

Such monorails may be designed as combined overhead and ground monorails, whereby the monorail is so structured that the moving gear is directed upwardly while during the transfer to the overhead monorail, the track transforms into a vertical running piece of track into which a gear rack is mounted and is engaged by a motor driven sprocket which is provided on the moving gear. In this case, the moving gear runs in the vertical track upwardly and then runs in a reversed positioned track section, whereby the laterally inwardly extending flanges serve as a support for the wheels or rollers of the moving gear and runs at this point as an overhead monorail.

It is an object of the subject improvement to provide a track for a combined monorail and overhead monorails of the above mentioned type which may be mounted in a simple manner on any suitable support and overhead structures. In accordance with the improvement, a track for combined monorail and overhead monorails is provided essentially consisting of a U-shaped section having inwardly extended flanges at their upper side for receiving rollers or wheels of a moving gear. There is also a power supply and control tracks as well as a gear rack at the lower range of the section. On the lower side of the U-shaped section as well as on the upper inwardly extending flanges, at least one each section shoulder is provided for mounting the track on a support or suspension structure.

In accordance with a special embodiment of the improvement, the inwardly extended flange is provided on the upper side with a unitary U-shaped section shoulder connected therewith. Also on the outer edges of the lower side of the U-shaped track section, a unitary U-shaped section shoulder is connected therewith having inwardly extending flanges, whereby the section shoulder is preferably connected unitary with the U-shaped track section.

The upper and lower mounting sections may have any suitable cross sections, for example, dove tail shaped, circular shaped, or the like. The track in accordance with the improvement essentially consists of aluminum, whereby the power tracks are mounted on insulating members spaced apart from each other on the bottom portion of the U-shaped track.

With respect to the appended single drawing, the improved track will now be described in detail in conjunction with a preferred embodiment.

Figure 1:
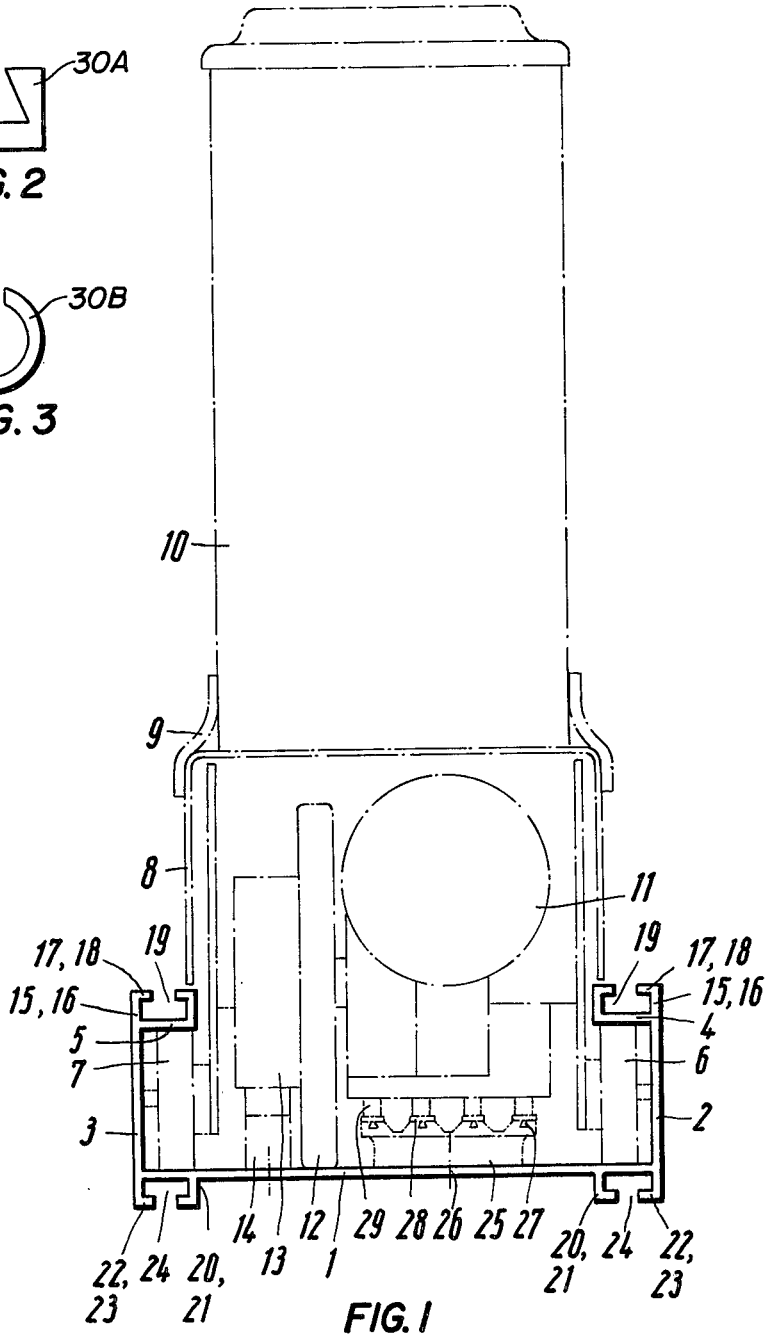
FIG. 1 is a cross sectional view of the track in accordance with the improvement.

In the embodiment shown, the track in accordance with the improvement consists of a relatively wide U-shaped section made of aluminum having a bottom portion 1 and two side portions 2 and 3 which on their upper sides are provided with inwardly extending flanges 4 and 5. Within the hollow space formed by these flanges, rollers 6 and 7 of a moving gear 8 run therein, which are shown in dotted lines in the drawing. Moving gear 8 is detachably connected with a pay-load container 10 by means of clamping members 9, so that when each clamping member 9 is opened, container 10 may be removed from moving gear 8. By means of a suspended drive assembly which swings on bearings and is shown in principle in FIG. 1, a traction wheel 12 and sprocket 13 mounted on the same shaft are driven. Sprocket 13 cooperates with a gear rack 14 which is also provided on bottom portion 1, in particular during the vertical running. The inwardly extended flanges 4 and 5 are provided with a unitary connected upwardly open ended U-shaped section with lateral ribs 15 and 16 as well as with inwardly directed flanges 17 and 18. Within the hollow space formed thereby, suitable screw and clamping elements of support or suspension structures may be mounted in order to define the path of the track.

On the lower side of bottom 1 in the range of the lateral edges, U-shaped sections are provided consisting of ribs 20 and 21 as well as the inwardly directed flanges 22 and 23 which are unitarily connected with bottom portion 1.

Figure 2:
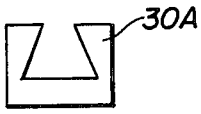
FIG. 2 is a cross-sectional view of an alternative embodiment of the upper and lower mounting sections illustrated in FIG. 1.
Figure 3:
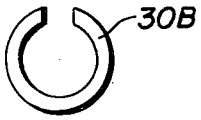
FIG. 3 is a cross-sectional view of another alternative embodiment of the upper and lower mounting section illustrated in FIGS. 1 and 2.

As previously pointed out, both of these upper and lower mounting sections may have other suitable cross-sections. Thus, as shown in FIG. 2, they may be provided with a dove-tail shape 30A or, as illustrated in FIG. 3, with a circular or annular shape having an open slot 30B. Here too corresponding mounting elements for mounting the track on a suitable support and suspension structure may be provided in hollow spaces 24. Preferably, trapezoidally shaped insulating elements 25 are mounted on the inner surface of bottom portion 1 by means of screws 26, whereby the insulating elements are provided with a recess 27 at their upper side in which the power supply and/or control tracks 28 are mounted. These power supply tracks which preferably consist of copper, cooperate with sliders or rollers 29 of a current collector provided in moving gear 8.

The track in accordance with the improvement may be used as a monorail for moving gear 8 having an upwardly directed opening. However, the track may be turned by about 180°, so that the opening is directed downwardly, so that the downwardly directed opening receives moving gear 8 in form of an overhead monorail, and the rollers or wheels 6 and 7 engage flanges 4 and 5.

While only a single embodiment has been shown and described, it will be obvious to those skilled in the art that many changes and modifications may be made thereto without departing from the spirit and scope of the invention.

What is claimed is:

1. A track for a combined monorail and overhead monorail for slidably supporting an accessory device having a power supply control tracks and at least a pair of roller members comprising:

a U-shaped rail section including a base wall and two sidewalls secured to the ends of said base wall and extending upwardly therefrom, each of said sidewalls having a flange extending inwardly from its upper edge which cooperates with said base wall to slidably receive therebetween the roller members of the accessory device; and at least one shoulder section extending along the length of said rail section formed on the lower surface of the bottom wall of said rail section as well as on the upper surface of one of the flanges of said sidewalls, said shoulder section having two arms extending generally outwardly therefrom, the ends of which extend toward one another, to define therebetween an outwardly opened, longitudinally disposed channel extending therethrough, for mounting the track on a suitable support or suspension system.

2. The track according to claim 1 wherein said shoulder section is U-shaped with inwardly extending flanges.

3. The track according to claim 1 wherein at least one shoulder section has a dove tail shape.

4. The track according to claim 1 wherein at least one shoulder section is provided with an annular section having an open slot.

5. The track according to claim 1 comprising insulating members for supporting the power supply and control tracks of the accessory device on the base wall of said U-shaped track section.

6. The tracks as recited in claim 5 comprising screws for securing the control tracks to the insulating device.

* * * * *